US012471662B2

(12) United States Patent
Park

(10) Patent No.: US 12,471,662 B2
(45) Date of Patent: Nov. 18, 2025

(54) FOOTWEAR WITH CORK OUTSOLE

(71) Applicant: Bass Pro Intellectual Property, L.L.C., Springfield, MO (US)

(72) Inventor: Jinwoo Park, Springfield, MO (US)

(73) Assignee: BASS PRO INTELLECTUAL PROPERTY, L.L.C., Springfield, MO (US)

( * ) Notice: Subject to any disclaimer, the term of this patent is extended or adjusted under 35 U.S.C. 154(b) by 13 days.

(21) Appl. No.: 17/720,997

(22) Filed: Apr. 14, 2022

(65) Prior Publication Data

US 2023/0329391 A1 Oct. 19, 2023

(51) Int. Cl.
*A43B 13/02* (2022.01)
*A43B 13/12* (2006.01)

(52) U.S. Cl.
CPC ..... *A43B 13/026* (2013.01); *A43B 13/122* (2013.01)

(58) Field of Classification Search
CPC ..... A43B 13/026; A43B 13/122; A43B 13/04; A43B 1/06
See application file for complete search history.

(56) References Cited

U.S. PATENT DOCUMENTS 1,182,200 A * 5/1916 Norris ..... A43B 13/125 427/403
2,250,987 A * 7/1941 Dunbar ..... A43B 13/04 524/925
RE33,648 E * 7/1991 Brown ..... A43B 13/12 36/154
5,720,118 A * 2/1998 Mayer ..... A43B 13/38 36/107
5,930,916 A * 8/1999 Connor ..... A43B 7/1455 36/141
9,049,900 B1 * 6/2015 Cox ..... A43B 1/0027
9,538,814 B2 * 1/2017 DelCielo ..... A43D 8/02
9,867,419 B1 * 1/2018 Warner ..... A43B 13/16
9,961,961 B2 * 5/2018 Smith ..... A43B 13/08
2003/0009919 A1 * 1/2003 Stein ..... A43B 13/26 36/59 R
2003/0118745 A1 * 6/2003 Vanlandeghem ..... B41M 1/40 427/535
2004/0020080 A1 * 2/2004 Cox ..... A43B 7/145 36/103
2008/0229625 A1 * 9/2008 Frasson ..... A43B 13/24 12/146 B
2011/0099853 A1 * 5/2011 DelCielo ..... A43B 17/12 12/146 B
2011/0119954 A1 * 5/2011 Ortiz ..... A43B 21/46 36/42
2015/0164179 A1 * 6/2015 Walborn ..... A61F 5/0195 36/25 R
2016/0044991 A1 * 2/2016 Walsh ..... A43B 13/122 36/44
2016/0302514 A1 * 10/2016 Martinazzo ..... A43B 5/0405
2018/0020766 A1 * 1/2018 Edwards ..... A43B 13/141 36/97
2018/0360159 A1 * 12/2018 Lin ..... A43B 3/122
(Continued)

*Primary Examiner* — Bao-Thieu L Nguyen
(74) *Attorney, Agent, or Firm* — Dinsmore & Shohl LLP

(57) ABSTRACT

An improved article of footwear with a molded polymeric sole, the improvement comprising a layer of cork covering at least 51% of the surface of the outsole. The layer of cork is in direct contact with the molded polymer that forms the sole, without any intervening layer.

13 Claims, 7 Drawing Sheets

(56) References Cited

U.S. PATENT DOCUMENTS

| | | | | |
|---|---|---|---|---|
| 2019/0231029 | A1* | 8/2019 | Dardinski | A43B 3/108 |
| 2020/0390192 | A1* | 12/2020 | Culp | B32B 7/12 |
| 2021/0245467 | A1* | 8/2021 | Ha | A43B 17/006 |
| 2023/0071487 | A1* | 3/2023 | Urban Bru | B29D 35/128 |
| 2023/0284727 | A1* | 9/2023 | Borgogna | A43D 25/047 |

* cited by examiner

FOOTWEAR WITH CORK OUTSOLE

FIELD

This disclosure relates to footwear and in particular to footwear with polymeric soles with cork outsoles.

BACKGROUND

This section provides background information related to the present disclosure which is not necessarily prior art.

Footwear with polymeric soles are well known, attempts have been made to provide such footwear with a cork outsole by securing a cork layer to a fabric scrim and applying the composite to the bottom of a polymeric sole. This was complicated and expensive, and was unsatisfactory because as the cork wore away, the fabric scrim was exposed.

SUMMARY

This section provides a general summary of the disclosure, and is not a comprehensive disclosure of its full scope or all of its features.

Embodiments of the present disclosure provide footwear with polymeric soles having a cork outsole, in which the cork is embedded in the surrounding polymeric sole, so that as the cork wears away, such as in normal use, the sole does not significantly change appearance. In some embodiments this is facilitated by making the cork and the surrounding polymeric material the same color, for example black. In some embodiments the outsole can have raised tread shapes forming the contact surfaces that contact the ground in use, and cork comprises at least about 51% of the surface of these contact surfaces.

According to other aspects of this disclosure, methods of making footwear with polymeric soles having a cork outsole are provided. According to one preferred embodiment, this method includes forming a thin flexible ply of cork. This thin flexible ply of cork is positioned in the bottom of a sole mold. Polymeric material is added to the mold and formed into a polymeric sole. The completed polymeric sole with cork outsole can be combined with a footwear upper to form an article of footwear, with a polymeric sole with an outsole with an exposed cork surface. The thin flexible layer of cork can be fabricated by steaming cork particles and pressing the particles into a thin coherent layer.

The cork layer and the polymeric material can be made of the same color to enhance the appearance of the sole and outsole, and to maintain an attractive and consistent appearance as the cork layer is worn away through use. In some elements the outsole can have raised tread shapes forming the contact surfaces that contact the ground in use, and cork from the cork ply preferably comprises at least about 51% of the surface of these contact surfaces, and more preferably at least about 70-75% of the surface of these contact surfaces.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Embodiments of this disclosure provide an articular of footwear with a polymeric sole and a cork outsole. According to a first and second preferred embodiments, an improved article of footwear with a molded polymeric sole is provided. The improvement relates to an improved polymeric sole, indicated generally as 20 in FIGS. 1-7 and 20' in FIGS. 8-14. The improvement comprises a layer of cork 22 covering at least 70%, and more preferably at least 75%, of the surface of the outsole 24 of the soles 20 and 20'. In particular, it is desirable that at least 51%, of the outsole 24 that normally contacts the ground has a cork surface. The layer of cork is embedded in, and in direct contact with, the molded polymer forming the sole 20 and 20', without an intervening layer as was used in the prior art.

The cork layer is preferably a coherent ply preformed by steaming cork particles and pressing them into a thin layer of between about 1 mm and about 2 mm thick. Of course some other method of forming the cork ply can be used, for example forming a cork block, and shaving or cutting thin layers from the cork block.

In a particularly preferred embodiment shown in FIGS. 8 to 14, the cork in the cork layer is the same color as the polymer in the molded polymeric sole. While as shown in FIGS. 8-14, the cork and the polymer of the sole are black, a common color for the soles footwear, they could be some other color if desired. The cork layer can be dyed, stained or painted. Various coloring agents can be added to the polymeric material forming the sole. Having the cork layer the same color as the sole help to maintain an attractive appearance of the sole as the cork wears away during normal use.

Figure 1:
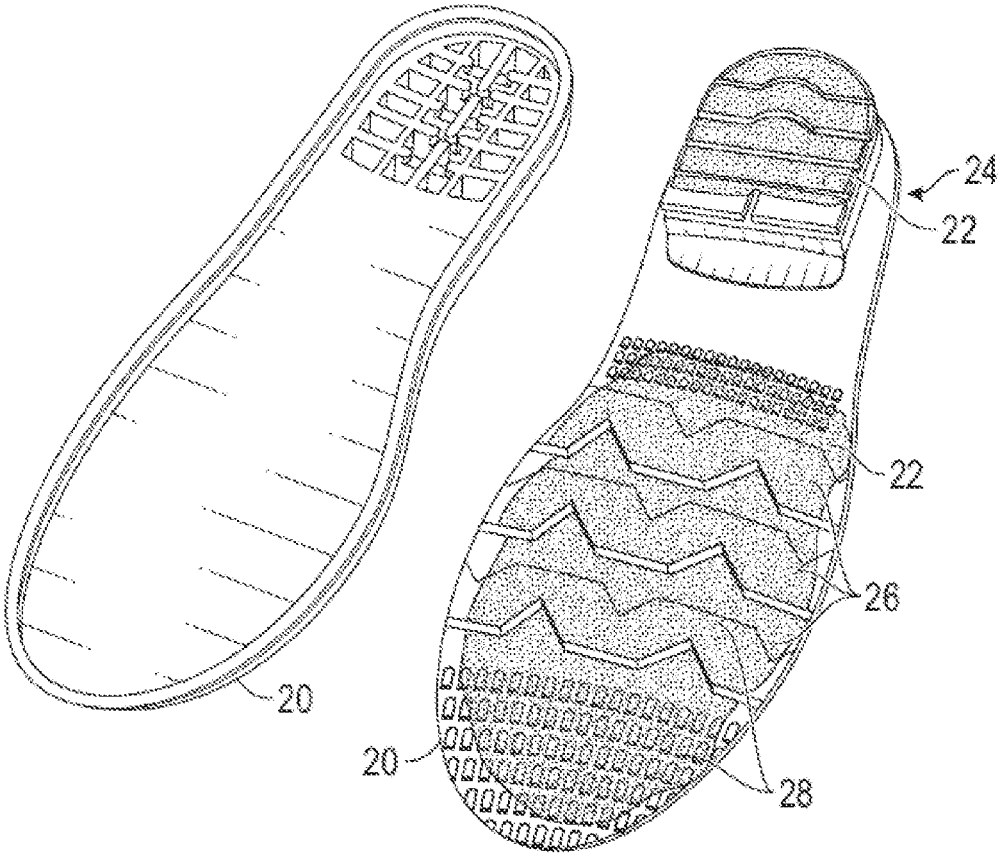
FIG. 1 is a photographic view of the top and bottom surfaces of a polymeric sole with a cork surfaced outsole in accordance with a first embodiment of this disclosure.
Figure 2:
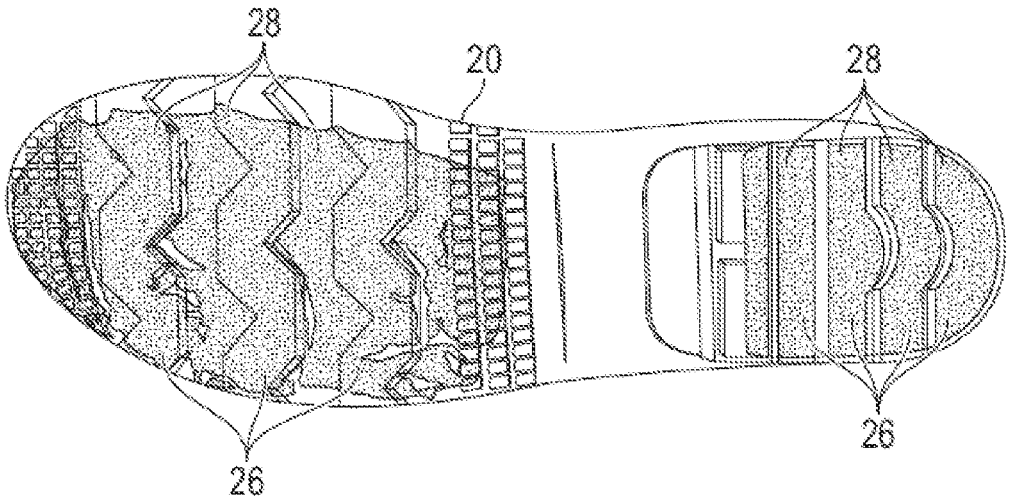
FIG. 2 is an enlarged photographic view of the bottom surface of the polymeric sole with a cork-surfaced outsole of the first embodiment.
Figure 3:
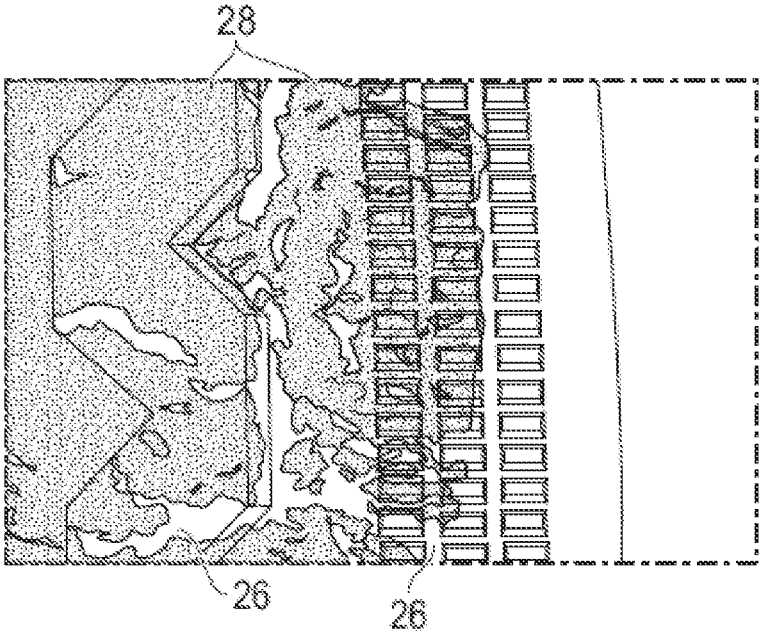
FIG. 3 is a further enlarged, partial photographic view of the bottom surface of the polymeric sole with a cork-surfaced outsole of the first embodiment.
Figure 4:
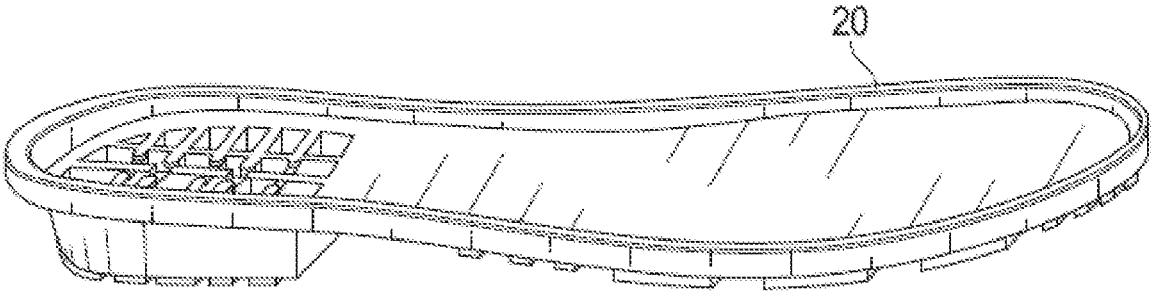
FIG. 4 is a top perspective view of the polymeric sole with a cork-surfaced outsole of the first embodiment, from the outstep side.
Figure 5:
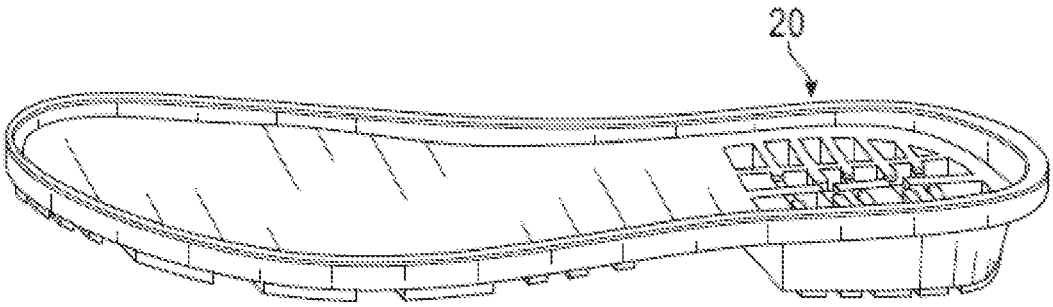
FIG. 5 is a top perspective view of the polymeric sole with a cork-surfaced outsole of the first embodiment, from the instep side.
Figure 6:
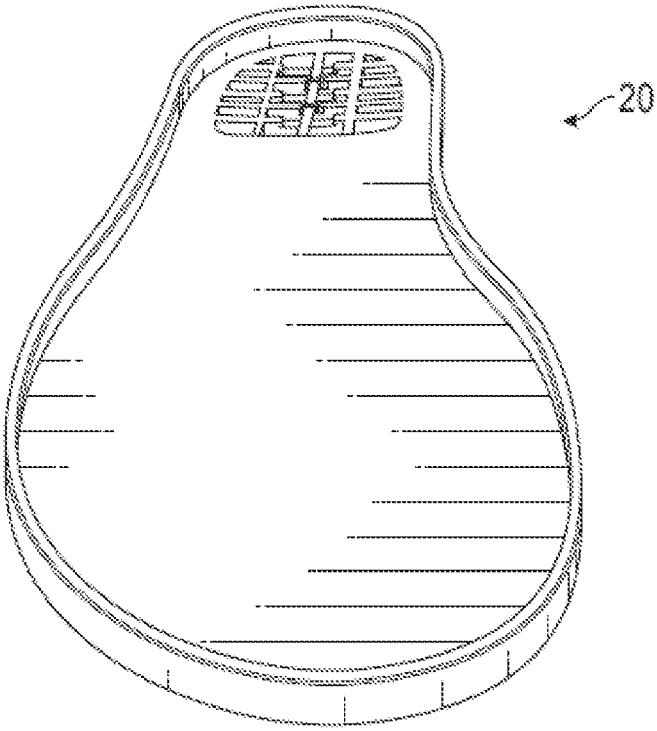
FIG. 6 is a top perspective view of the polymeric sole with a cork-surfaced outsole of the first embodiment, from the toe end.
Figure 7:
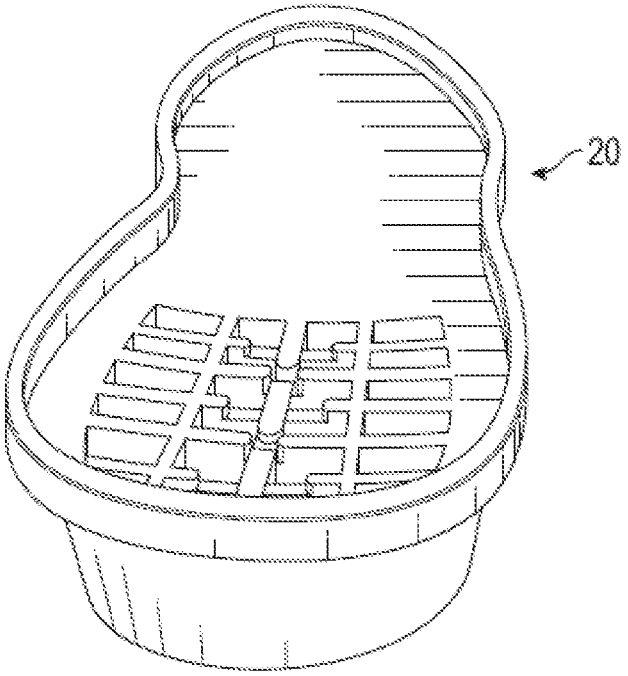
FIG. 7 is a top perspective view of the polymeric sole with a cork-surfaced outsole of the first embodiment, from the heel end.

In some embodiments, the outsole can be formed with various tread shapes 26 forming contact surfaces 28 that contact the ground in use, sidewalls 29 which extend therefrom, and a trough 30 which extends therebetween. The exposed cork of the cork layer preferably comprises at least about 51% of the surface of the contact surfaces 28. This is most easily seen in FIGS. 1-3 showing sole 20, where the color of the cork contrasts with the color of the polymeric material of the sole. There is an economic advantage to having the cork layer form at least 51% of the contact surfaces of the sole 20 because footwear made with the soles 20 or 20' qualifies for lower customs duties.

The tariffs on imported footwear is significantly impacted by the nature of the sole of that footwear. For example, according to the current Harmonized Tariff Schedule of the United States Revision 2 (2022) Cork soled shoes (shoes in which at least 51% of the contact surfaces on the soles are made of cork), with textile uppers are subject to a tariff at a rate of 12.5%/Subheading 6405.90.20) compared to a tariff at a rate of 37.5% for (Tariff Heading 6404.19.20) for the same shoes without a cork sole. This allows the importer to charge a lower overall price, while maintaining a consistent profit, or to increase the profit without increasing prices.

According to another embodiment of this disclosure, a method is provided for making an article of footwear with a polymeric sole having a cork-surfaced outsole. According to one preferred embodiment of this method, a thin, flexible ply of cork is made. This thin flexible ply of cork is then place in the bottom of a sole mold. Polymeric material is added to the mold, and the polymeric sole formed. This sole can be combined with an upper, which can be made of any suitable material including textile, rubber or plastic, or real or artificial leather, to form an article of footwear that has a polymeric sole with an exposed cork surface on its outsole.

As discussed above the cork ply is preferably preformed by steaming cork particles and pressing them into a thin layer between about 1 mm and about 2 mm inches thick, and more preferably. Of course some other method of forming the cork ply can be used, for example forming a block, and shaving or cutting thin layers from the block.

Figure 8:
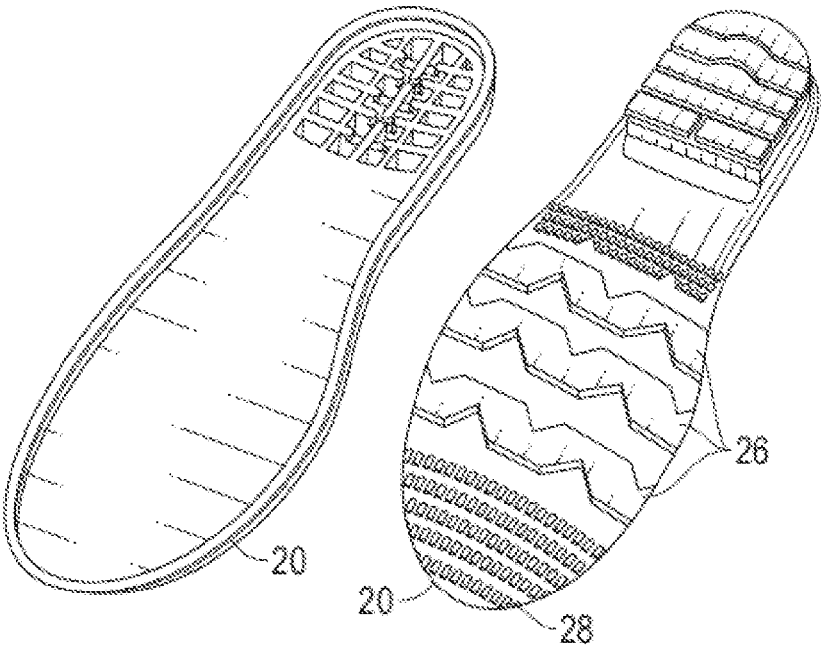
FIG. 8 is a photographic view of the top and bottom surfaces of a polymeric sole with a cork surfaced outsole in accordance with a second embodiment of this disclosure.
Figure 9:
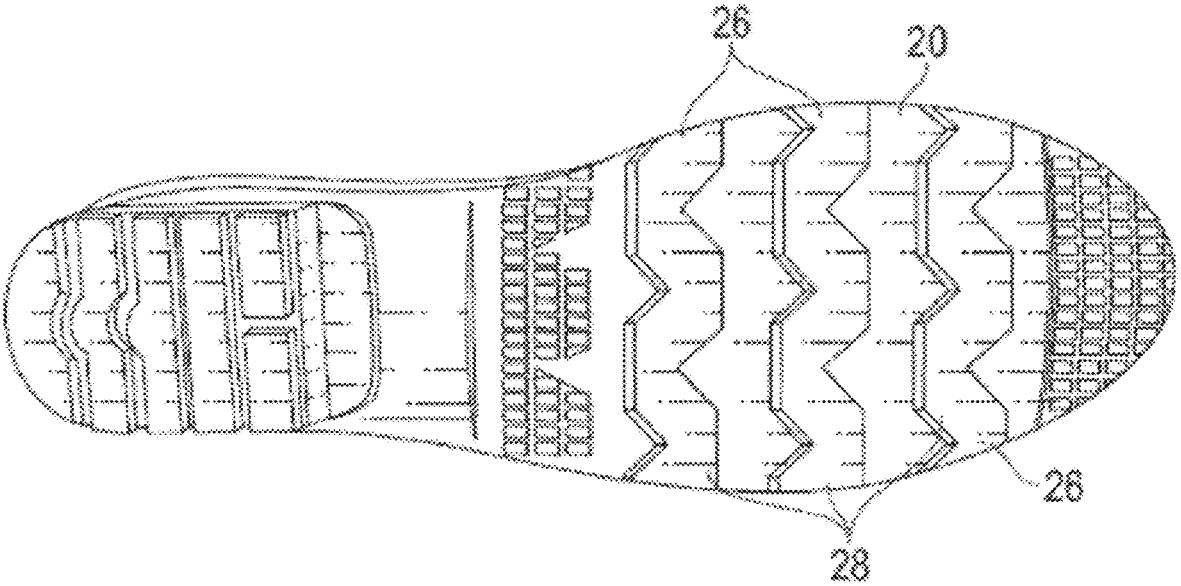
FIG. 9 is an enlarged photographic view of the bottom surface of the polymeric sole with a cork-surfaced outsole of the second embodiment.
Figure 10:
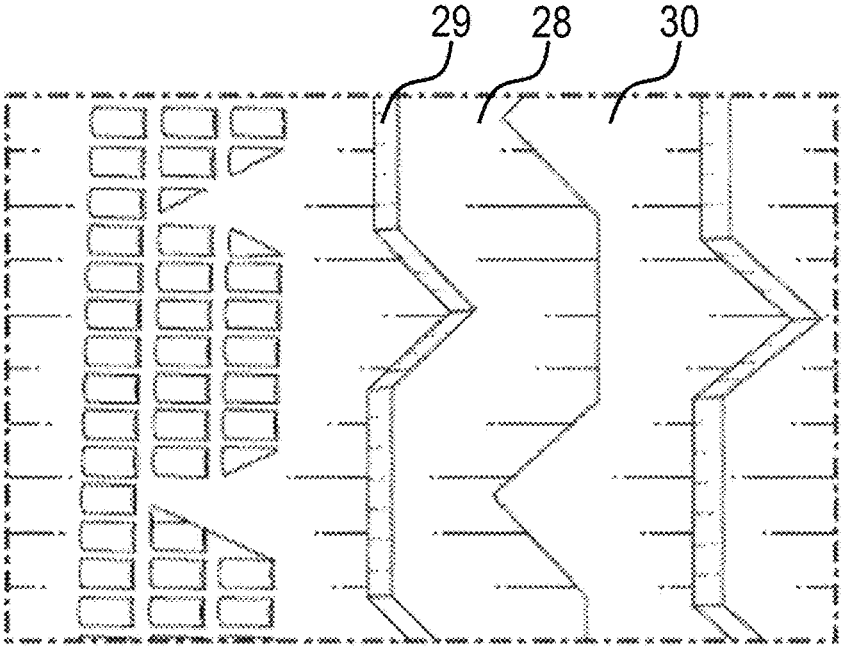
FIG. 10 is a further enlarged, partial photographic view of the bottom surface of the polymeric sole with a cork-surfaced outsole of the second embodiment.
Figure 11:
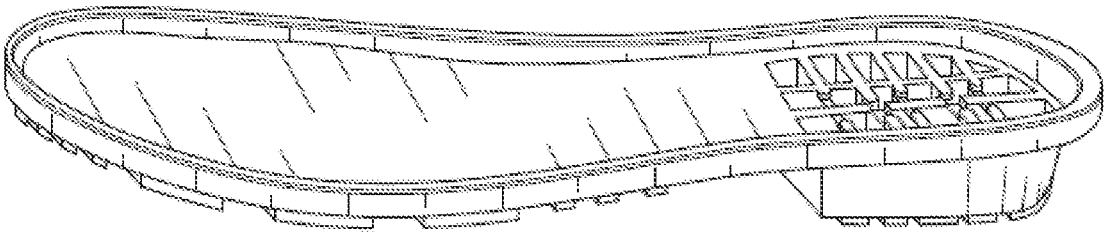
FIG. 11 is a top perspective view of the polymeric sole with a cork-surfaced outsole of the second embodiment, from the outstep side.
Figure 12:
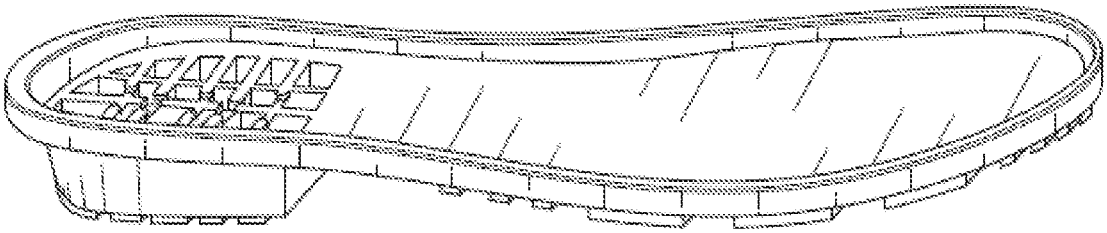
FIG. 12 is a top perspective view of the polymeric sole with a cork-surfaced outsole of the second embodiment, from the instep side.
Figure 13:
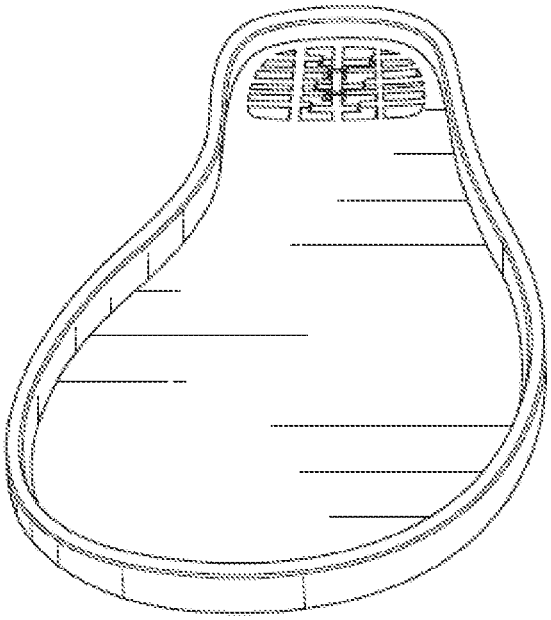
FIG. 13 is a top perspective view of the polymeric sole with a cork-surfaced outsole of the second embodiment, from the toe end.
Figure 14:
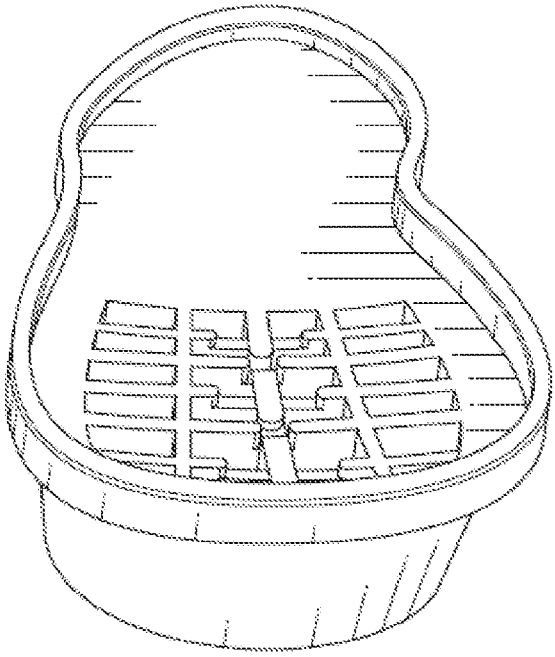
FIG. 14 is a top perspective view of the polymeric sole with a cork-surfaced outsole of the second embodiment, from the heel end.

In a particularly preferred embodiment, the cork in the cork ply is the same color as the polymer in the molded polymeric sole, for example black. The cork ply can be dyed, stained or painted. Various coloring agents can be added to the polymeric material forming the sole. Having the cork layer the same color as the sole helps to maintain the attractive appearance of the sole as the cork wears away during normal use. This is illustrated in FIGS. 8-10, showing that the areas of cork are difficult to discern from the areas of polymeric material.

In another preferred embodiment the sole mold is formed with various features to form raised tread shapes 26 that form contact surfaces 28 that contact the ground in use. Portions of the cork ply comprise at least about 51% of the surface of the contact surfaces, and at least about 70-75% of the total surface area.

The soles 20 and 20' can then be combined with an upper made of textile, plastic, rubber, natural or synthetic leather, or combinations of these to form an article of footwear. Because of the high percentage of the contact surface of the outersoles of the footwear, the footwear qualifies for lower import duties, as explained above. Further because the cork ply or layer is embedded in and surrounded by the polymeric sole, there is no need for a backing or scrim that can be exposed as the cork wears away. Further, where the cork of the cork layer is the same color as the polymer in the sole, the outsole maintains its appearance, a further advantage of the second preferred embodiment of FIGS. 8-14.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

a molded polymeric sole; and a layer of cork, wherein:

the molded polymeric sole and the layer of cork define a contact surface that contacts the ground when the article of footwear is in use;

at least 51% of the contact surface comprises the layer of cork;

the layer of cork is embedded in and directly contacts the molded polymeric sole; and the contact surface is at least partially defined by a plurality of raised tread shapes formed within the molded polymeric sole; and at least a portion of the layer of cork is embedded in a sidewall of the plurality of raised tread shapes, the sidewall being adjacent the contact surface.

2. The article of footwear according to claim 1, wherein the cork in the cork layer is the same color as the molded polymeric sole.

3. The article of footwear according to claim 1, wherein the cork in the cork layer and the molded polymeric sole are black.

4. The article of footwear according to claim 1, wherein the layer of cork is formed by steaming and compressing a plurality of cork particles into a flexible ply.

5. The article of footwear according to claim 4, wherein the flexible ply is between 1 mm and 2 mm thick.

6. The article of footwear according to claim 1, wherein the layer of cork is formed by slicing a block of cork that has been formed by steaming and compressing a plurality of cork particles.

7. The article of footwear according to claim 1, further comprising a textile upper.

8. The article of footwear of according to claim 1, wherein the layer of cork comprises an inner surface and an outer surface, wherein the inner surface of the layer of cork directly contacts the molded polymeric sole.

9. The article of footwear of according to claim 8, wherein the molded polymeric sole consists of molded polymer and the layer of cork.

10. The article of footwear according to claim 1, wherein the raised tread shapes transition unbroken from the cork layer to the molded polymeric sole.

11. The article of footwear according to claim 1, wherein a first of the raised tread shapes is formed by both the cork layer and the molded polymeric sole.

12. The article of footwear according to claim 1, wherein the molded polymeric sole is a unitary body.

13. The article of footwear according to claim 1, wherein at least a portion of the layer of cork is embedded in a trough extending between two or more of the plurality of raised tread shapes, the trough being adjacent at least one sidewall.

* * * * *